US005385816A

United States Patent [19]

Stanley et al.

[11] Patent Number: 5,385,816

[45] Date of Patent: Jan. 31, 1995

[54] PHOTOGRAPHIC SILVER HALIDE COLOR MATERIALS WITH SULFONYLHYDRAZINE COLOR DEVELOPER

[75] Inventors: Paul L. R. Stanley, Harrow; Siu C. Tsoi, Watford, both of United Kingdom

[73] Assignee: Eastman Kodak Company, Rochester, N.Y.

[21] Appl. No.: 29,644

[22] Filed: Mar. 11, 1993

[30] Foreign Application Priority Data

Apr. 29, 1992 [GB] United Kingdom ..... 9209258

[51] Int. Cl.[6] ..... G03C 7/26; G03C 7/30; G03C 7/32

[52] U.S. Cl. ..... 430/544; 430/380; 430/957; 430/223

[58] Field of Search ..... 430/380, 544, 223

[56] References Cited

U.S. PATENT DOCUMENTS

| | | | |
|---|---|---|---|
| 2,424,256 | 7/1947 | Schmidt et al. | 430/380 |
| 3,467,520 | 9/1969 | Puschel et al. | 430/380 |
| 3,869,291 | 3/1975 | Mader et al. | 430/544 |
| 4,108,663 | 8/1978 | Tanaka et al. | 430/544 |
| 4,684,604 | 8/1987 | Harder | 430/223 |
| 4,791,049 | 12/1988 | Kojima et al. | 430/544 |
| 5,196,291 | 3/1993 | Okada et al. | 430/544 |
| 5,278,025 | 1/1994 | Okamura et al. | 430/544 |
| 5,284,739 | 2/1994 | Clarke et al. | 430/380 |

FOREIGN PATENT DOCUMENTS

| | | |
|---|---|---|
| 242685 | 10/1987 | European Pat. Off. . |
| 63/316857 | 12/1988 | Japan . |
| 64/000546 | 4/1989 | Japan . |
| 83/00939 | 3/1983 | WIPO . |

*Primary Examiner*—Richard L. Schilling
*Attorney, Agent, or Firm*—Sarah Meeks Roberts

[57] ABSTRACT

This invention provides a color photographic element comprising, in an adjacent silver halide emulsion layer, (1) a development inhibitor releasing developer (IRD) which comprises a hydrazide, sulphonamidophenol, sulphonamidonaphthol, or hydroquinone moiety attached directly or via a linking group to a development inhibitor moiety which compound is oxidizable during silver halide development enabling release of the development inhibitor moiety under alkaline conditions, (2) a sulphonhydrazide color developing agent, and (3) a color coupler capable of forming image dye with the sulphonhydrazide during silver halide development.

15 Claims, No Drawings

PHOTOGRAPHIC SILVER HALIDE COLOR MATERIALS WITH SULFONYLHYDRAZINE COLOR DEVELOPER

BACKGROUND OF THE INVENTION

The present invention relates to photographic silver halide color materials and to processes for the formation of photographic color images.

Existing commercial photographic silver halide color materials form dye images by the reaction of oxidized p-phenylenediamine color developers with a color coupler. The color developing solutions employed contain the color developing agent and used developer solutions need to be disposed of safely. Attempts have been made to incorporate p-phenylene-diamine color developing agents into silver halide photographic materials but these have had little success largely due to the pronounced staining produced.

The use of aryl and heterocyclic sulphonhydrazides as color developers in aqueous color developer solutions which form an azo dye on coupling with a color coupler are described in U.S. Pat. No. 2,424,256, and copending British application 9125688.3 respectively.

It is well known in conventional p-phenylenediamine color forming chemistry to release a group from the coupling position (usually called a Coupling Off Group or COG) which has a photographic effect, e.g. development inhibition. By the release of such a compound one color layer can affect the image formation in an adjacent color layer. Such an effect is not available to sulphonhydrazide image forming chemistry as shown by the following scheme:

Scheme 1

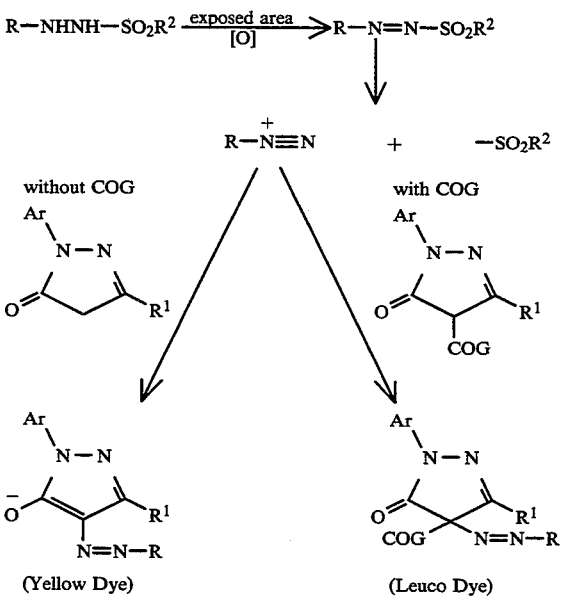

The leuco dye is essentially colorless and the COG cannot leave to form a dye.

U.S. Pat. No. 4,108,663 describes the use of inhibitor releasing sulphonamido-phenol developers (IRDs) in conventional p-phenylene-diamine color forming chemistry.

European Patent 0 242 685 describes hydrazide compounds that release photographically useful fragments during silver halide development.

The present invention employs compounds which are capable of releasing a development inhibitor in systems where the color developer is a sulphonhydrazide.

SUMMARY OF THE INVENTION

According to the present invention there is provided a color photographic element comprising at least one color-forming unit sensitive to a particular region of the spectrum comprising a silver halide emulsion layer and, in or adjacent said layer, (1) a development inhibitor releasing developer (IRD) which comprises a hydrazide, sulphonamidophenol, sulphonamidonaphthol, or hydroquinone moiety attached directly or via a linking group to a development inhibitor moiety which compound is oxidizable during silver halide development enabling release of the development inhibitor moiety under alkaline conditions, (2) a sulphonhydrazide color developing agent, and (3) a color coupler capable of forming image dye with the sulphonhydrazide during silver halide development.

DETAILED DESCRIPTION OF THE INVENTION

In a preferred embodiment development takes place in the presence of an electron transfer agent (ETA). Preferably, the alkaline! solution contains ETA, for example a pyrazolidinone. A specific ETA that may be used is 4-hydroxymethyl-4-methyl-1-phenylpyrazolidin-3-one.

The IRD preferably has the formula:

$$\text{RED—(LINK)}_n\text{—INHIB} \qquad (1)$$

wherein RED is a hydrazide, sulphonamidophenol, sulphonamidonaphthol, or hydroquinone moiety oxidizable during photographic color development leading to the release of INHIB or LINK-INHIB by means of alkaline hydrolysis, $\beta$-elimination, intramolecular nucleophilic displacement or an addition-elimination reaction, INHIB is a heterocyclic photographic development inhibitor moiety, LINK is a group attached to a heteroatom of INHIB and is capable, in an alkaline environment, of releasing INHIB from LINK-INHIB, and n is 0 or 1.

In one embodiment the IRD, the color coupler and the sulphonhydrazide color developer are incorporated into the photographic element in droplets of a high boiling coupler solvent. It is especially preferred to codisperse the IRD, the coupler and the developer in the same droplet.

The RED group may have one of the formulae:

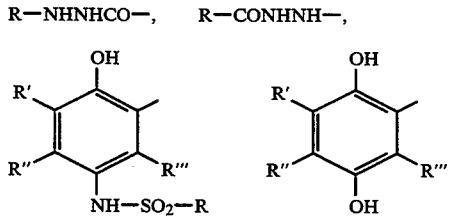

wherein

R is a substituted or unsubstituted alkyl, alkenyl or aryl group,

R′, R″ or R‴ are each H or a substituted or unsubstituted alkyl, alkenyl or aryl group, or together with the carbon atoms to which they are attached, R′ and R″ complete a ring, and wherein at least one of R, R′, R″ or R‴ is a ballast group.

The group LINK may be:

$-O-CH_2-$, $-(CH_2\underset{|}{C}HCO-O-R^6)_m$,

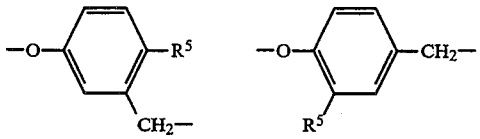

where m is 1 or 2, $R^5$ is H, $-NHSO_2R$, —NHCOR, or halogen, and $R^6$ is an alkyl group, or, together with RED, LINK forms part of the ring:

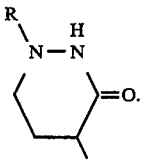

The INHIB moiety may be derivable from any of the heterocyclic development inhibitors referred to in Research Disclosure Item 308119, Section F, December 1989 published by Kenneth Mason Publications, Emsworth, Hants, United Kingdom. Examples are moieties derived from tetrazoline thiols, e.g. 1-phenyl-5-mercaptotetrazole, thiadiazoline thiol or benzotriazole.

Examples of IRD compounds according to the present invention are:

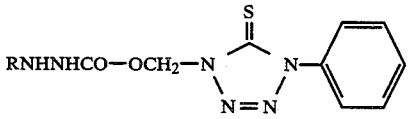

| Compound No | R |
|---|---|
| 1. | 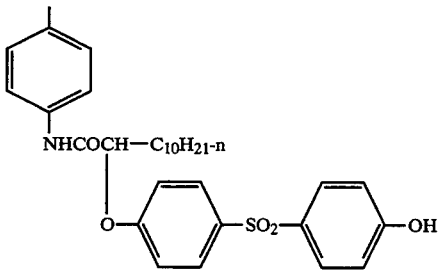 |

-continued

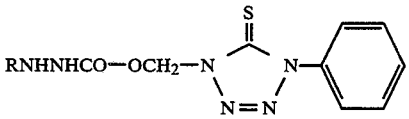

| Compound No | R |
|---|---|
| 2. | 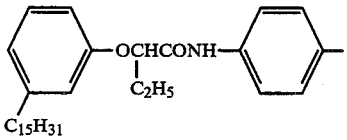 |
| 3. | 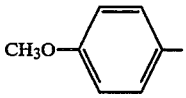 |
| 4. | 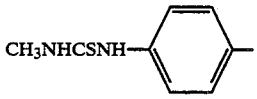 |
| 5. | 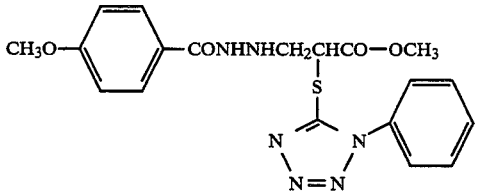 |
| 6. | 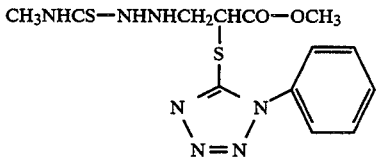 |
| 7. | 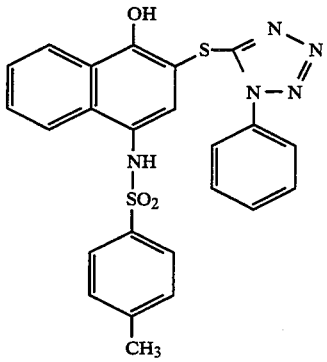 |
| 8. | 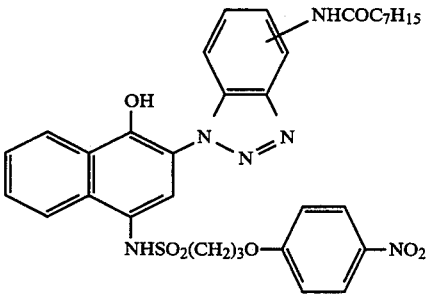 |

-continued

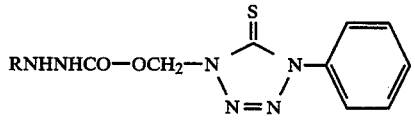

| Compound No | R |
|---|---|
| 9. | 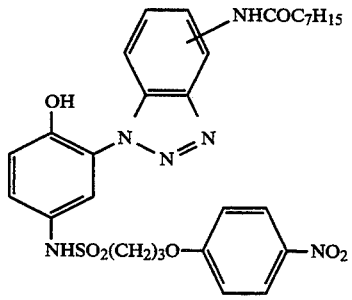 |
| 10. | 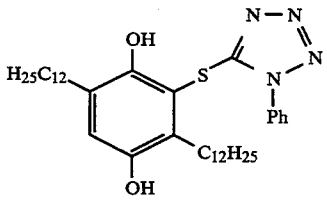 |
| 11. | 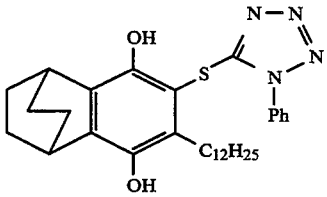 |
| 12. | 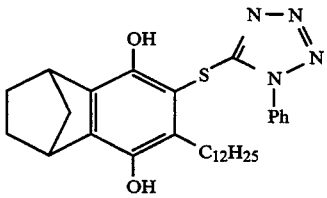 |
| 13. | 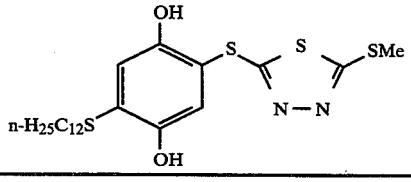 |

In addition to the compounds illustrated above other compounds which may be used are described in European Patent 4 242 685.

The present compounds form dye and release a photographically useful compound as follows:

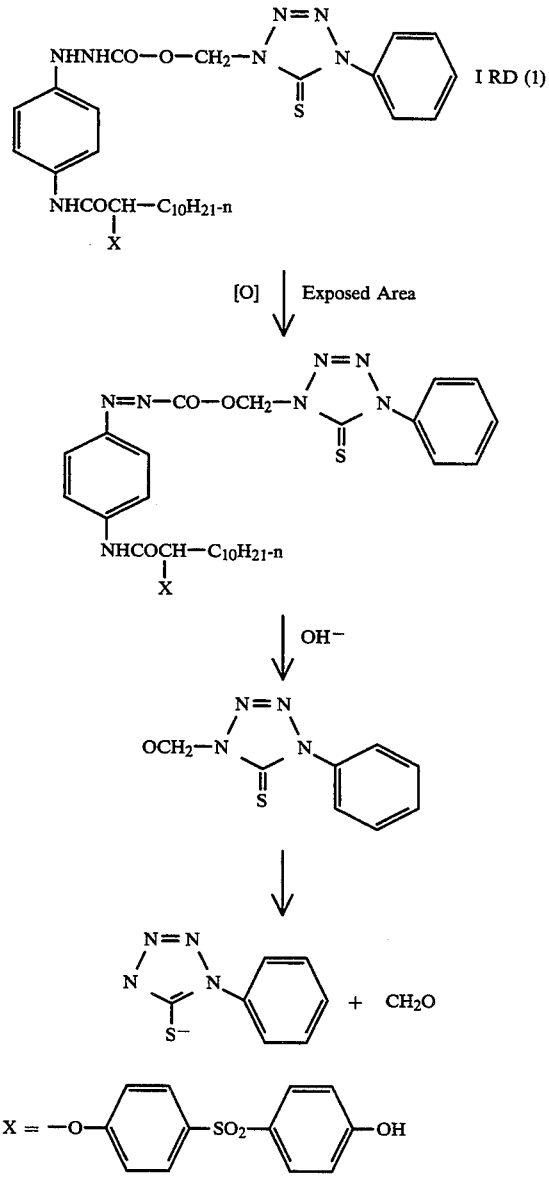

The IRD, coupler and sulphonhydrazide developing agent are associated with a silver halide emulsion layer coated on a support to form the photographic element.

As used herein, the term "associated with" signifies that the compound is incorporated in the silver halide emulsion layer or in a layer adjacent thereto where, during processing, it is capable of reacting with silver halide development products.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing yellow, magenta and cyan dye image-forming units comprising at least one blue-, green- or red-sensitive silver halide emulsion layer having associated therewith at least one yellow, magenta or cyan azo dye-forming coupler respectively. The element can contain additional layers, such as filter and barrier layers.

In the following discussion of suitable materials for use in the emulsions and elements of this invention, reference will be made to Research Disclosure, December 1978, Item 17643, published by Industrial Opportunities Ltd., The Old Harbourmaster's, 8 North Street, Emsworth, Hants P010 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

The photographic elements of this invention or individual layers thereof, can contain brighteners (see Research Disclosure Section V), antifoggants and stabilizers (see Research Disclosure Section VI), antistain agents and image dye stabilizer (see Research Disclosure Section VII, paragraphs I and J), light absorbing and scattering materials (see Research Disclosure Section VIII), hardeners (see Research Disclosure Section XI), plasticisers and lubricants (see Research Disclosure Section XII), antistatic agents (see Research Disclosure Section XIII), matting agents (see Research Disclosure Section XVI) and development modifiers (see Research Disclosure Section XXI).

The photographic elements can comprise a variety of supports as described in Research Disclosure Section XVII and the references described therein.

The photographic elements can be exposed to actinic radiation, typically in the visible region of the spectrum, to form a latent image.

Preferred sulphonhydrazide color developing agents have the formula:

$$R—NHNH—SO_2—R^1 \quad (2)$$

wherein

R is a heterocyclic group which may be substituted, and $R^1$ is an alkyl, aryl or heterocyclic group, either of which may be substituted, and wherein R or $R^1$ contains a ballasting group of such size and configuration as to render the compound non-diffusible.

When the ballast group is in group R, the diazo compound formed on development is unable to diffuse and a water-soluble sulphinato compound is formed which washes out of the photographic element. When, however, the ballast group is part of $R^1$, a mobile diazonium compound is formed while the sulphinate compound is ballasted and remains in the material.

The high boiling solvent which may be used to incorporate the IRD, color developer and color coupler in the photographic element may be any solvent already known as a coupler solvent (and used for incorporating couplers into photographic elements). Many such solvents are listed in Research Disclosure Item 308119, December 1989 published by Kenneth Mason Publications, Emsworth, Hants, United Kingdom. The color developer may be incorporated in the same or different droplets of coupler solvent used for the couplers themselves.

When the ballast group is in group R, it is preferred to co-disperse both coupler and color developing agent and IRD in the same droplet of coupler solvent.

The heterocyclic sulphonhydrazide developing agents may have one of the following general formulae:

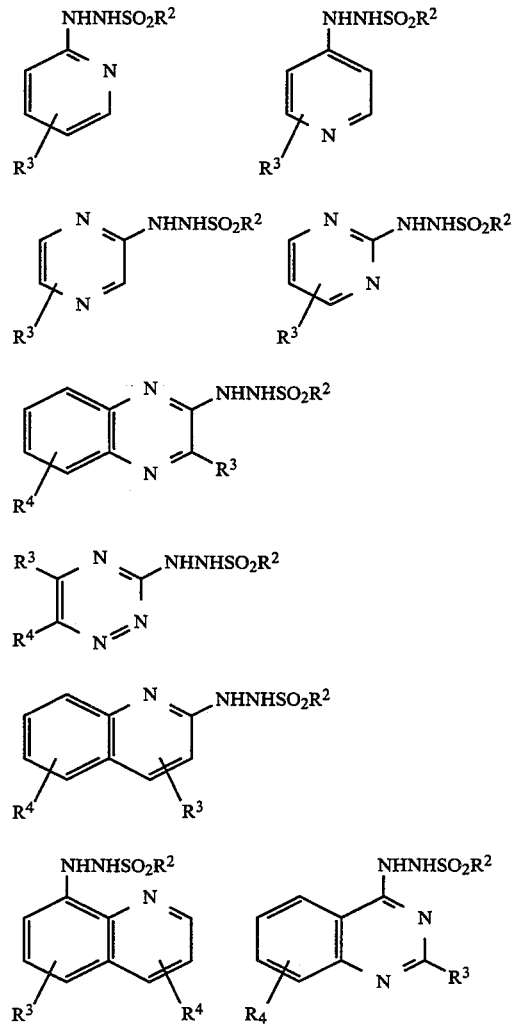

$R^2$ is alkyl or substituted alkyl, or a substituted or unsubstituted aromatic heterocyclic group, $R^3$ is H, alkyl, aryl, alkoxy, Cl, F, or, especially, an electron-withdrawing group such as $CF_3$, COMe, $CONH_2$, COOAlkyl CN, $SO_2R$, $SO_2NHR$, and $R^4$ is H or a general organic substituent.

In all the above examples, the developer may be ballasted through a suitable group present in $R^2$and/or the substituents $R^3$ and $R^4$ on the heterocyclic ring.

Examples of sulphonhydrazides are:

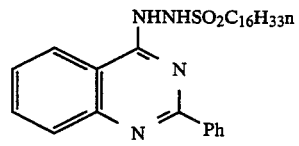

(D1)

-continued (D2)

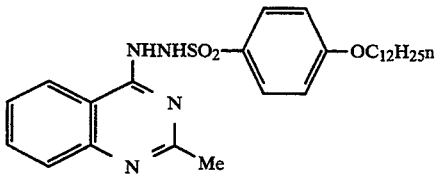

(D3)

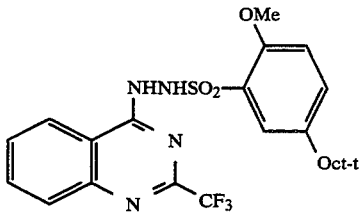

(D4)

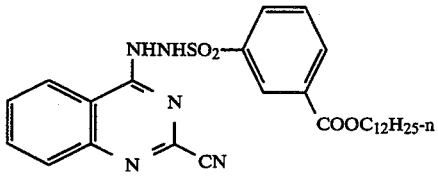

(D5)

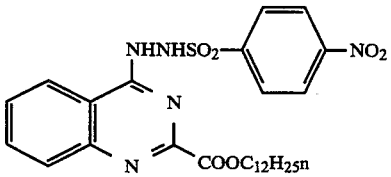

(D6)

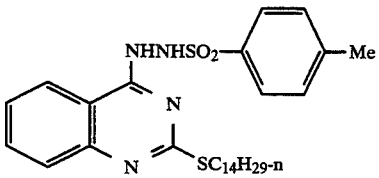

(D7)

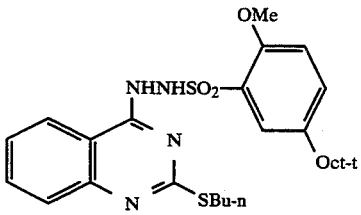

(D8)

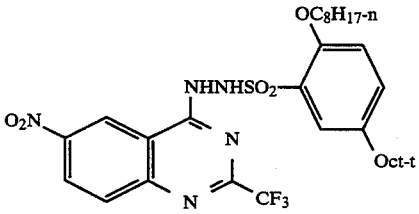

(D9)

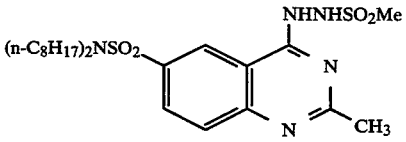

-continued (D10)

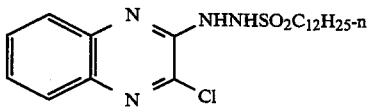

(D11)

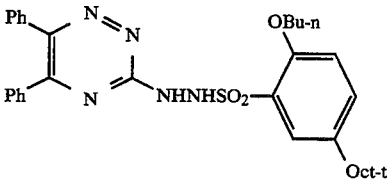

With negative-working silver halide emulsions the processing leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is preferably followed by the conventional steps of bleaching, fixing, or bleach-fixing, to remove silver and silver halide, washing and drying.

A 1 minute post-process base dip (pH 10.4 solution—$Na_2CO_3$ 26.5 g/l and $NaHCO_3$ 6.3 g/l ) is required to obtain the azo-dye in its full-colored anionic form for magenta and cyan dyes.

The following Examples are included for a better understanding of the invention.

EXAMPLE 1

Dispersions

Co-dispersions of IRD (1) of the formula

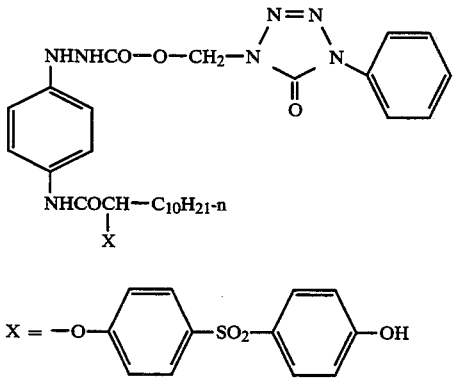

and the conventional image coupler of the formula:

(Y1)

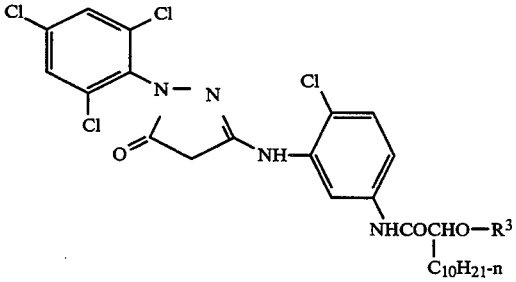

-continued

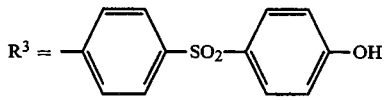

and the sulphonhydrazide developing agent of the formula:

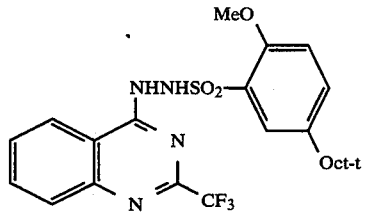

(D3)

are prepared by the following method.

The three coupler dispersions used contained w/w 6.0% gelatin, 8.8% coupler (Y1), 1 molar equivalent of developing agent (D3), 0.15, 0.10 or zero molar equivalents of IRD(1) respectively, and coupler solvents in the ratio coupler:tricresyl phosphate:2-(2-butoxyethoxy)ethyl acetate 1:0.5:1.5. The dispersions were washed for 6 hours at 4° C.

Coatings

The coupler/developer/IRD dispersions were coated with a green sensitized silver bromoiodide emulsion in the following format:

| | | |
|---|---|---|
| Gel supercoat | Gelatin | 1.5 $gm^{-2}$ |
| Emulsion Layer | Silver bromoiodide | 1.60 $gm^{-2}$ |
| | Coupler (+dev+IRD) | 1.04 $mmol^{-2}$ |
| | Gelatin | 2.42 $gm^{-2}$ |
| | Bis(vinylsulphonyl)-methane(hardener) | 0.06 $gm^{-2}$ |
| Support | Cellulose acetate | |

The coatings were slit and chopped into 30 cm×35 mm strips and exposed (0.1 sec, DLV+WR9 filters) and processed through the following sequence using an activator solution of the given composition.

| Processing Sequence | |
|---|---|
| Activator | 2.5 min |
| Wash | 1.0 min |
| Bleach | 4.0 min |
| Wash | 2.0 min |
| Fix | 4.0 min |
| Wash | 2.0 min |
| **Activator Solution** | |
| $Na_2CO_3$ | 26.5 g/l |
| $NaHCO_3$ | 6.3 |
| $Na_2SO_3$ | 2.0 |
| NaBr | 1.0 |
| 4-hydroxymethyl-4-methyl-1-phenylpyrazolidin-3-one | 0.2 |
| pH = 10.4 | |

The maximum density and contrast obtained from the resulting anionic yellow dye are shown in Table 1 below.

TABLE 1

| % IRD (1) | $D_{max}$ | Contrast (γ) |
|---|---|---|
| 0 | 1.48 | 1.24 |
| 10 | 1.15 | 1.04 |
| 15 | 0.94 | 0.76 |

The data demonstrate that development inhibitor is released from IRD (1).

What is claimed is:

1. A multicolor photographic element comprising at least one color-forming unit sensitive to a particular region of the spectrum comprising a silver halide emulsion layer and, in or adjacent said layer, (1) a development inhibitor releasing developer (IRD) which comprises a hydrazide, sulphonamidophenol, sulphonamidonaphthol, or hydroquinone moiety attached directly or via a linking group to a development inhibitor moiety which compound is oxidisable during silver halide development enabling release of the development inhibitor moiety under alkaline conditions, (2) a sulphonhydrazide color developing agent having the formula $$R—NHNH—SO_2—R^1,$$

wherein R is a substituted or unsubstituted heterocyclic group, $R^1$ is an substituted or unsubstituted alkyl, aryl or heterocyclic group, and R or $R^1$ contains a ballasting group of such size and configuration as to render the compound non-diffusible, and (3) a color coupler capable of forming image dye with the sulphonhydrazide during silver halide development.

2. A color photographic element as claimed in claim 1 in which the IRD has the general formula:

$$RED\text{-}(LINK)_n\text{-}INHIB \quad (1)$$

wherein RED is a hydrazide, sulphonamidophenol, sulphonamidonaphthol, or hydroquinone moiety oxidisable during photographic color development leading to the release of INHIB or LINK-INHIB by means of alkaline hydrolysis, β-elimination, intramolecular nucleophilic displacement or an addition-elimination reaction, INHIB is a heterocyclic photographic development inhibitor moiety, LINK is a group attached to a heteroatom of INHIB and is capable, in an alkaline environment, of releasing INHIB from LINK-INHIB, and n is 0 or 1.

3. A color photographic element as claimed in claim 2 in which the group RED has one of the formulae:

R—NHNHCO—, R—CONHNH—,

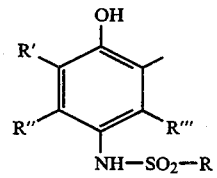

or

-continued

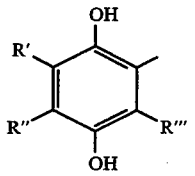

wherein

R is a substituted or unsubstituted alkyl, alkenyl or aryl group,

R′, R″or R‴ are each H or a substituted or unsubstituted alkyl, alkenyl or aryl group, or together with the carbon atoms to which they are attached, R′ and R″ complete a ring, and wherein at least one of R, R′, R″ or R‴ is a ballast group.

4. A color photographic element as claimed in claim 2 in which the group LINK is:

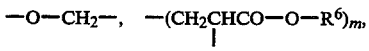

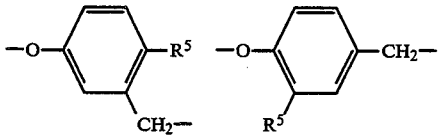

where m is 1 or 2, $R^5$ is H, —$NHSO_2R$, —NHCOR, or halogen, and $R^6$ is an alkyl group, or, together with RED, LINK forms part of the ring:

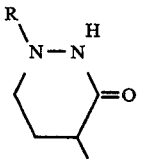

wherein R is a substituted or unsubstituted alkyl, alkenyl or aryl group.

5. A color photographic element as claimed in claim 2 in which the INHIB moiety is derived from a tetrazoline thiol, a benzotriazole or a thiadiazoline thiol.

6. A color photographic element as claimed in claim 2 in which the IRD is one of the following compounds:

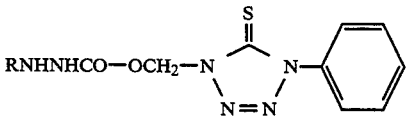

| Compound No | R |
|---|---|
| 1. | 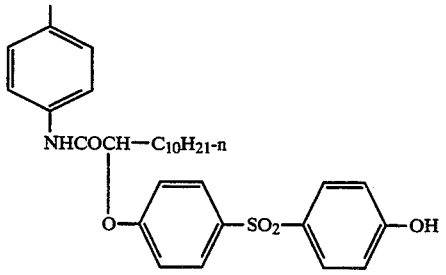 |
| 2. | 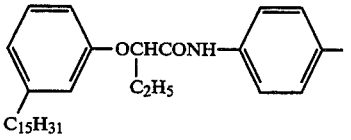 |
| 3. | 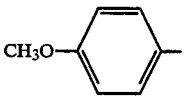 |
| 4. | 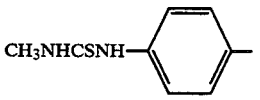 |
| 5. | 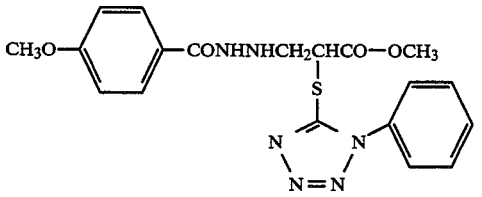 |
| 6. | 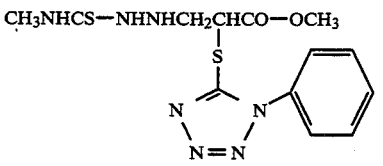 |
| 7. | 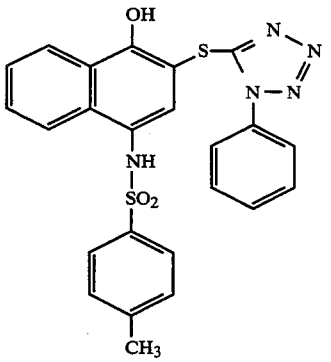 |

-continued

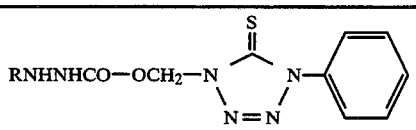

| Compound No | R |
|---|---|
| 8. | 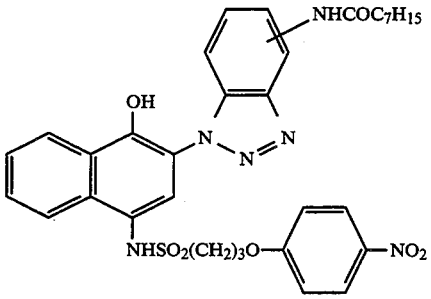 |
| 9. | 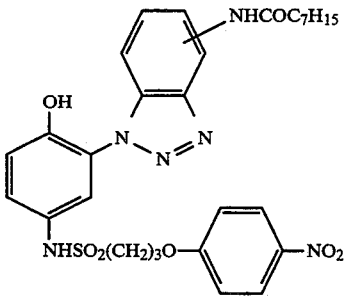 |
| 10. | 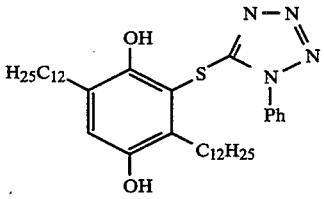 |
| 11. | 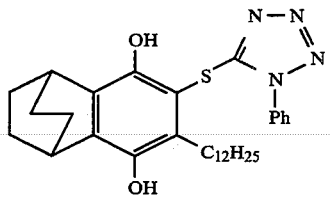 |
| 12. | 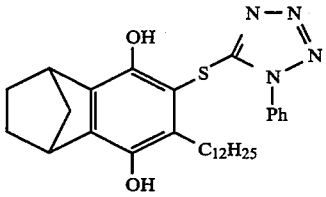 |
| 13. | 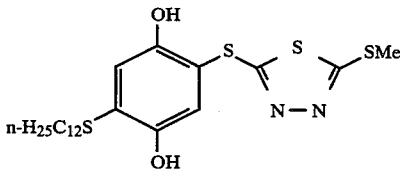 |

7. A color photographic element comprising at least one color-forming unit sensitive to a particular region of the spectrum comprising a silver halide emulsion layer and, in or adjacent said layer, (1) a development inhibitor releasing developer (IRD) which comprises a hydrazide, sulphonamidophenol, sulphonamidonaphthol, or hydroquinone moiety attached directly or via a linking group to a development inhibitor moiety which compound is oxidisable during silver halide development enabling release of the development inhibitor moiety under alkaline conditions, (2) a sulphonhydrazide color developing agent having the formula $$R—NHNH—SO_2—R^1,$$

wherein R is a substituted or unsubstituted heterocyclic group, $R^1$ is an substituted or unsubstituted alkyl, aryl or heterocyclic group, and R or $R^1$ contains a ballasting group of such size and configuration as to render the compound non-diffusible, and (3) a color coupler capable of forming image dye with the sulphonhydrazide during silver halide development;

wherein the IRD, the color coupler and the sulphonhydrazide color developer are incorporated into the photographic element in droplets of a high boiling coupler solvent.

8. A color photographic element as claimed in claim 7 in which the IRD has the general formula:

$$RED\text{-}(LINK)_n\text{-}INHIB \qquad (1)$$

wherein RED is a hydrazide, sulphonamidophenol, sulphonamidonaphthol, or hydroquinone moiety oxidisable during photographic color development leading to the release of INHIB or LINK-INHIB by means of alkaline hydrolysis, β-elimination, intramolecular nucleophilic displacement or an addition-elimination reaction, INHIB is a heterocyclic photographic development inhibitor moiety, LINK is a group attached to a heteroatom of INHIB and is capable, in an alkaline environment, of releasing INHIB from LINK-INHIB, and n is 0 or 1.

9. A color photographic element as claimed in claim 8 in which the group RED has one of the formulae:

R—NHNHCO—, R—CONHNH—,

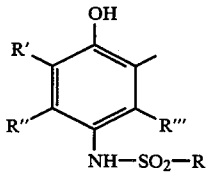

or

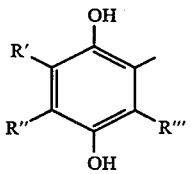

wherein

R is a substituted or unsubstituted alkyl, alkenyl or aryl group,

R′, R″ or R‴ are each H or a substituted or unsubstituted alkyl, alkenyl or aryl group, or together with the carbon atoms to which they are attached, R′ and R″ complete a ring, and wherein at least one of R, R′, R″ or R‴ is a ballast group.

10. A color photographic element as claimed in claim 8 in which the group LINK is:

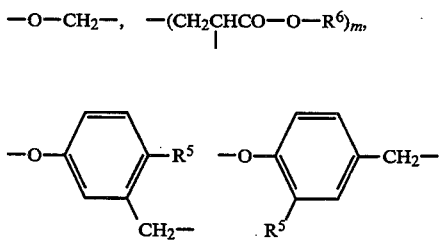

where m is 1 or 2, $R^5$ is H, —$NHSO_2R$, —NHCOR, or halogen, and $R^6$ is an alkyl group, or, together with RED, LINK forms part of the ring:

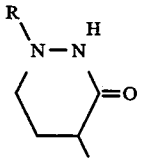

wherein R is a substituted or unsubstituted alkyl, alkenyl or aryl group.

11. A color photographic element as claimed in claim 8 in which the INHIB moiety is derived from a tetrazoline thiol, a benzotriazole or a thiadiazoline thiol.

12. A color photographic element as claimed in claim 8 in which the IRD is one of the following compounds:

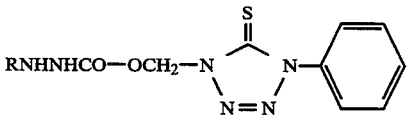

| Compound No | R |
|---|---|
| 1. | 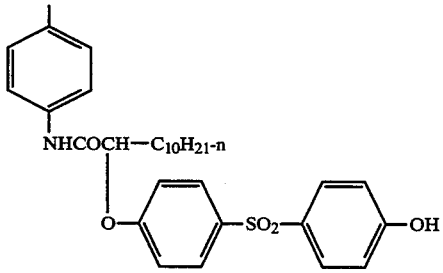 |

-continued

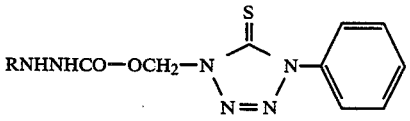

| Compound No | R |
|---|---|
| 2. | 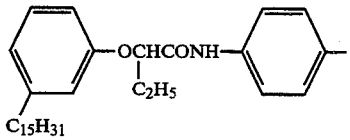 |
| 3. | 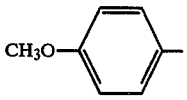 |
| 4. | 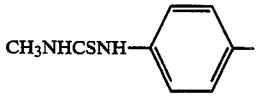 |
| 5. | 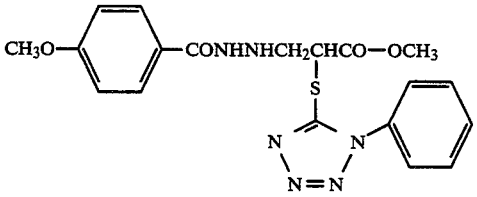 |
| 6. | 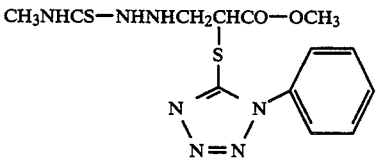 |
| 7. | 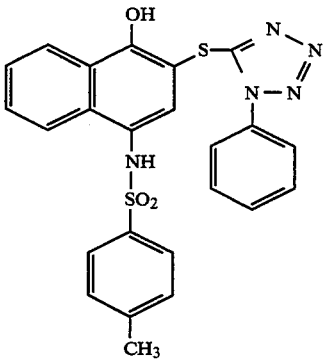 |
| 8. | 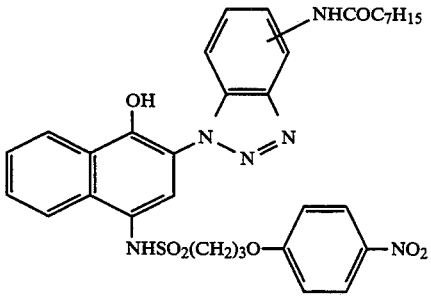 |

-continued

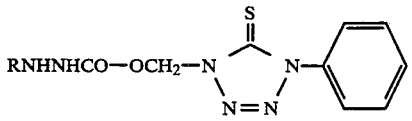

| Compound No | R |
|---|---|
| 9. | 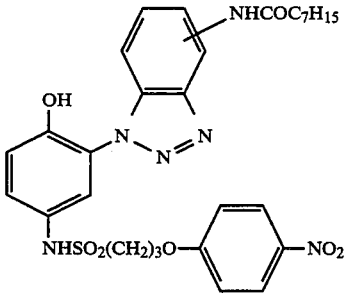 |
| 10. | 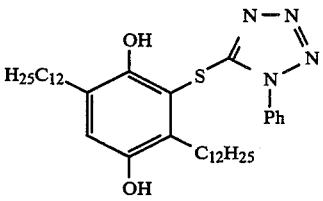 |
| 11. | 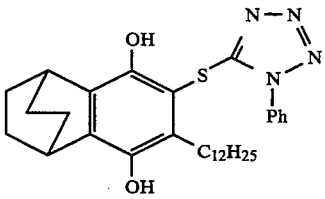 |

-continued

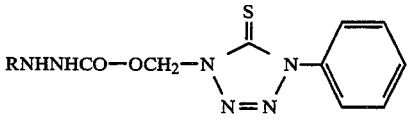

| Compound No | R |
|---|---|
| 12. | 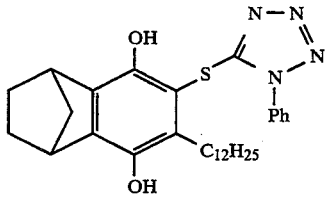 |
| 13. | 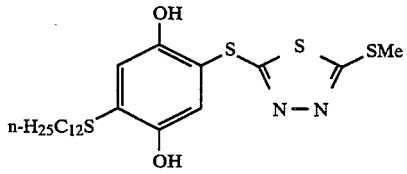 |

13. A color photographic element as claimed in claim 7 in which the IRD, the color coupler and the sulphonhydrazide color developing agent are codispersed in the same droplet.

14. A color photographic element as claimed in claim 7 in which the material is a multicolor photographic material comprising a support bearing a yellow dye image-forming unit comprised of at least one blue-sensitive silver halide emulsion layer having associated therewith at least one yellow azo dye-forming coupler, at least one magenta dye image-forming unit comprising at least one green-sensitive silver halide emulsion layer having associated therewith at least one magenta azo dye-forming coupler at least one cyan dye image-forming unit comprising at least one red-sensitive silver halide emulsion layer having associated therewith at least one cyan azo dye-forming coupler.

15. A color photographic element as claimed in claim 1 comprising a support bearing a yellow dye image-forming unit comprised of at least one blue-sensitive silver halide emulsion layer having associated therewith at least one yellow azo dye-forming coupler, at least one magenta dye image-forming unit comprising at least one green-sensitive silver halide emulsion layer having associated therewith at least one magenta azo dye-forming coupler at least one cyan dye image-forming unit comprising at least one red-sensitive silver halide emulsion layer having associated therewith at least one cyan azo dye-forming coupler.

* * * * *